United States Patent [19]

Kemp

[11] 4,243,090

[45] Jan. 6, 1981

[54] BURGLAR PROOF FIRE SAFE WINDOW COVERING

[76] Inventor: Alonzo Kemp, 108 Manchester Apt. 2211, Pontiac, Mich. 48054

[21] Appl. No.: 21,504

[22] Filed: Mar. 19, 1979

[51] Int. Cl.[3] ..... E06B 3/92

[52] U.S. Cl. ..... 160/145; 49/56; 49/67; 292/150

[58] Field of Search ..... 160/136, 144, 145, 146, 160/147, 148, 149, 150, 151; 49/50, 56, 61, 63, 67; 292/36, 150

[56] References Cited

U.S. PATENT DOCUMENTS

| | | | |
|---|---|---|---|
| 491,369 | 2/1893 | Moyer et al. | 292/150 |
| 1,290,176 | 1/1919 | Griffith | 160/144 |
| 1,374,878 | 4/1921 | Childers | 292/150 |
| 1,966,636 | 7/1934 | McGuinness | 49/56 |
| 2,016,044 | 10/1935 | McGuinness | 49/56 |
| 2,194,415 | 3/1940 | Bennett | 160/144 |
| 2,711,565 | 6/1955 | Levin | 49/56 |
| 2,924,862 | 2/1960 | Pellicore | 49/67 |
| 3,087,750 | 4/1963 | Kelly | 49/56 |
| 3,953,939 | 5/1976 | Klein | 49/56 |
| 4,000,590 | 1/1977 | Kordewick | 49/56 |

*Primary Examiner*—Peter M. Caun

*Attorney, Agent, or Firm*—Basile, Weintraub & Hanlon

[57] ABSTRACT

A burglar proof fire safe window covering is disclosed. The device comprises: a plurality of vertical bars slidingly supported at an upper and a lower end by a pair of spaced apart tracks; a plurality of pin engaging apertures at the upper and lower ends of the bars; an upper and lower plurality of vertically movable pins releasably biased into engagement with the apertures; and means for releasably engaging the pins in the apertures. A device is provided for aligning the apertures with the pins when the bars are deployed in an extended position. The window is designed so that it can be quickly and easily opened from the inside for escape of the buildings occupants in the event of a fire.

9 Claims, 8 Drawing Figures

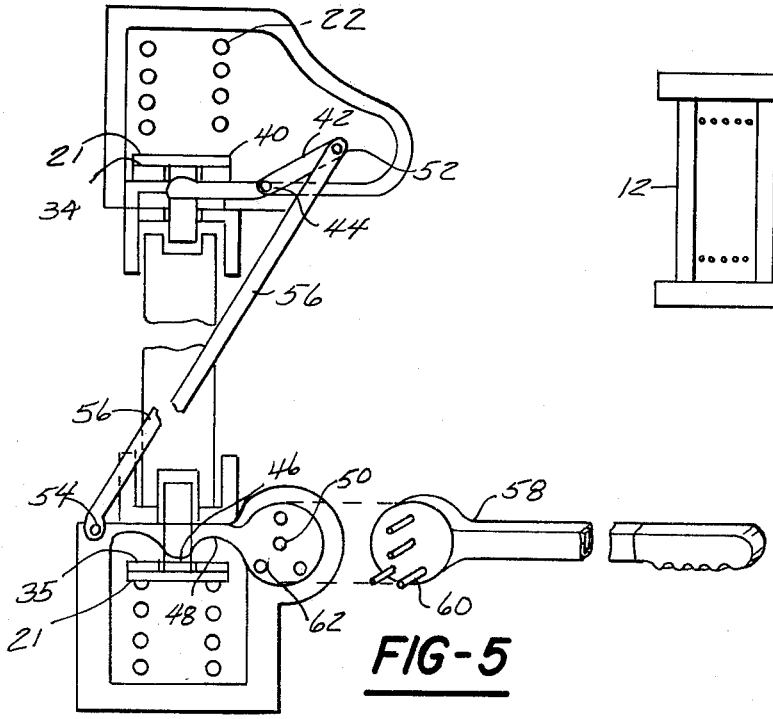
FIG-5
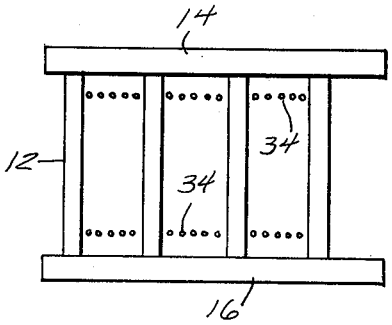
FIG-3
FIG-4
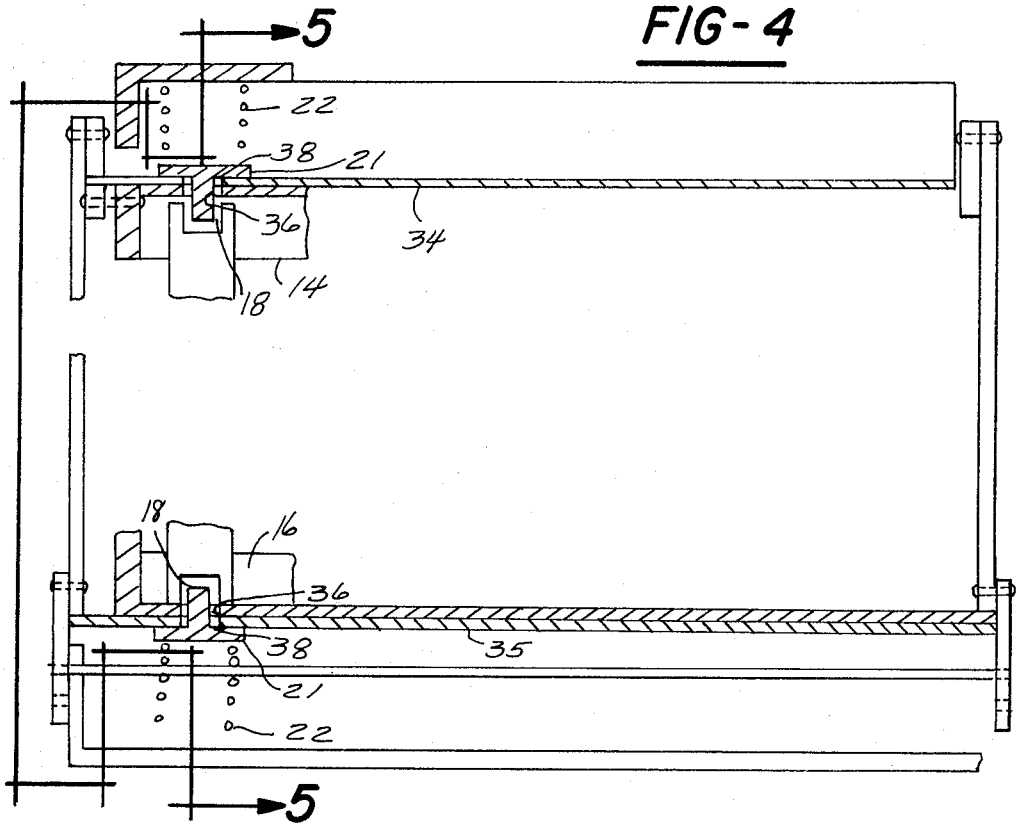

BURGLAR PROOF FIRE SAFE WINDOW COVERING

BACKGROUND OF THE INVENTION

I. Field of the Invention

The present invention relates to the field of burglar proof dwelling enclosures. More specifically the present invention relates to the field of burglar proof window coverings for dwellings. Even more specifically, the present invention relates to the field of burglar proof window coverings for dwellings which are easily opened from the inside in the event of an emergency.

II. Description of the Prior Art

Burglar proof locks, doors, and window coverings have long been known. U.S. Pat. No. 1,781,468 discloses an improved sash lock for casement windows. U.S. Pat. No. 1,899,466 discloses an improved closure and locking means for double hung windows used in a dwelling. U.S. Pat. No. 2,755,654 discloses an improved lock for casement windows and doors. U.S. Pat. No. 3,512,821 discloses a lock assembly for locking double hung windows in a dwelling. None of the above listed United States Patents disclose a burglar proof window covering for windows of a dwelling which is quickly and easily opened in the event of an emergency.

The above listed United States Patents constitute the entire prior art known to the applicant.

SUMMARY OF THE INVENTION

The present invention comprises a burglar proof fire safe window covering which is easily opened from the inside of the dwelling in the event of an emergency. The window is not openable from the outside of the dwelling. An outer shield of hardened steel is provided in one embodiment to prevent a burglar from sawing the bolt to gain access to the dwelling. The burglar proof covering comprises a plurality of vertical bars slidingly supported at an upper and lower end by a pair of spaced apart tracks disposed along the upper and lower inside edges of the window. A plurality of pin engaging apertures at the upper and lower ends of the bars are selectively engaged and disengaged by an upper and lower plurality of vertically movable pins releasably biased into engagement with the apertures. A device is provided for engaging the pins in the apertures when the bars are to be secured to prevent access to the dwelling by a burglar. The pins are released from engagement with the apertures allowing the bars to be moved to the side of the window when it is desired to exit from the dwelling by way of the window.

The pins are spring biased into engagement with the apertures, and a vertically movable horizontal wall is employed to simultaneously move the pins from engagement with the apertures when it is desired to move the bars to the side along the track. An upper and lower lever operated pair of cams are employed to move the wall against a pin projection to move the pins out of engagement with the apertures. A link joins the cam levers so that simultaneous disengagement of the upper and lower sets of pins is accomplished when the lever is rotated from a first position wherein the pins are in engagement with the apertures to a second position wherein the pins are released from engagement with the apertures. A removable handle is employed to rotate the levers from the first position to the second position, when the handle is removed a burglar cannot reach the cam levers for rotation.

For a more complete understanding of the present invention, reference is made to the following detailed description and accompanying drawings.

Other objects, advantages, and applications of the present invention will become apparent to those skilled in the field to which this invention pertains when the accompanying description of the best modes contemplated from practicing the invention are read in conjunction with the accompanying drawings.

BRIEF DESCRIPTION OF THE DRAWINGS

In the drawings, like reference numbers refer to like parts throughout the several views, and wherein:

FIG. 3 illustrates another embodiment of the device of FIG. 1 wherein chains are used to space the bars;

FIG. 4 illustrates a front view of the device for selectively engaging or disengaging the pins from the apertures;

FIG. 5 illustrates a sectional end view of the device of FIG. 4 taken along the line 5—5 of FIG. 4;

DESCRIPTION OF THE PREFERRED EMBODIMENT

Figure 1:
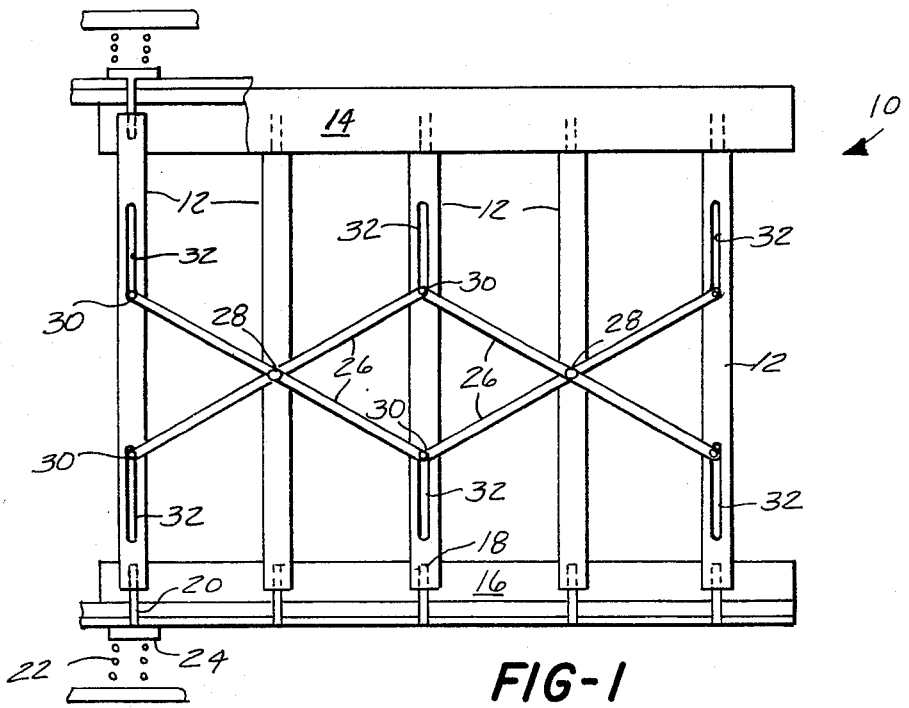
FIG. 1 illustrates a front view of a preferred embodiment of the present invention.

Referring now to the drawings and in particular to FIG. 1 wherein there is illustrated at 10 a preferred embodiment of the present invention comprising a plurality of vertical bars 12 supported between a pair of spaced apart tracks 14, 16. A plurality of apertures 18 in the upper and lower ends of each bar 12 selectively engage a plurality of pins 20 which are biased into engagement with the apertures 18 by a plurality of springs 22 biased against a projection 21 of the pins 20.

Figure 2:
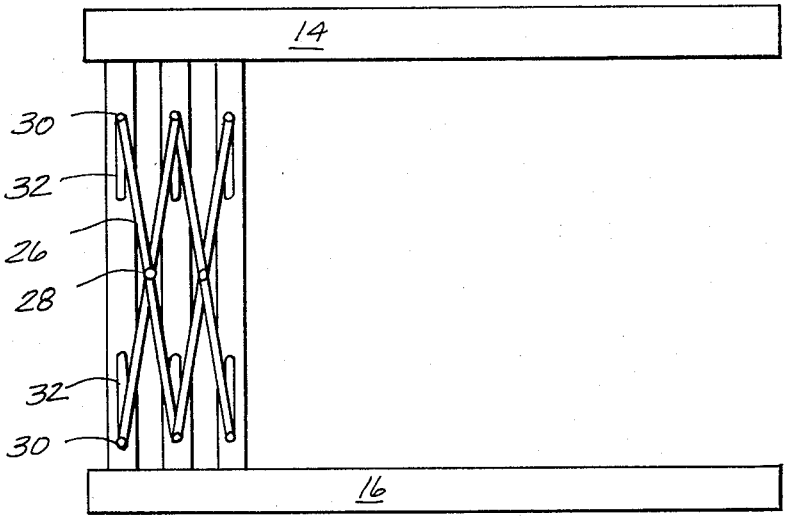
FIG. 2 illustrates the device of FIG. 1 with the bars moved to the side for emergency exit through the window.

The bars 12 are held in an equal spaced relationship by a plurality of scissor bars 26 which are pivoted at their center by a pivot 28. A pin 30 is affixed to the ends of the bar 26 and the pin rides in a groove 32 disposed in an adjacent bar. The scissor bars 26, the pivots 28, the pins 30, and the grooves 32 cooperate to form an extending scissors linkage to mechanically establish an equal spacing between bars as they are extended and to hold the bars parallel to each other as they are extended and retracted. The scissors linkage cooperates to induce all bars to be aligned with their pins 20 when one bar has been aligned with its pin 20. An alternate means for positioning the bars when in their extended position in alignment with their pin 20, is illustrated in FIG. 3 wherein a plurality of equal length chains 34 are deployed between bars 12 so that when the bars are extended the chains 34 assure that the bars are parallel to one another and deployed in line with the pins 20. FIG. 2 illustrates the device of FIG. 1 deployed to its opened position.

Referring now to FIGS. 4 and 5 wherein there is illustrated a device for withdrawing the pins 20 from engagement with the apertures 18. An upper vertically movable horizontal wall 34 and a lower vertically movable horizontal wall 35 are disposed along the upper end and lower end of the bars 12 respectively. A plurality of apertures 36 through the horizontal walls are aligned with a plurality of apertures 38 in the tracks 14, 16 and the pins 20 pass through the apertures 36, 38 to engage the apertures 18 in the bars 12. A projection 21 along an end of the pin 20 abuts the biasing spring 22 which biases the pins 20 into engagement with the apertures 18. A cam 40 actuated by a lever 42 pivoting about a pivot 44 urges the upper horizontal wall against the projection 21 to compress the biasing spring 22 removing the pin 20 from engagement with the aperture 18. A second cam 46 actuated by a lever 48 pivoting about a pivot point 50 engages the lower horizontal wall 35 into abutment with the projection 21 of the pin 20 compressing the spring 22 to move the pin 20 out of engagement with the aperture 18. A pair of pivots 52 and 54 at the end of the levers 42 and 48 are affixed to the ends of a link 56 which rotates the levers 42 and 48 simultaneously. Rotation of the lever 48 about the axis 50 causes simultaneous withdrawl of the pins 20 from engagement with the apertures 18. A removable handle 58 has at one end a plurality of pins 60 which project therefrom to engage a plurality of apertures 62 spaced about the pivot 50. Insertion of the pins 60 into the apertures 62 allows the handle 58 to rotate the lever 48 to release the pins 20 from engagement with the apertures 18. A pair of links 56 disposed on each end of the window with an accompanying linkage as described hereinabove allows the horizontal walls 34, 35 to be moved simultaneously from each end of the bars allowing a simultaneous withdrawl of the pins 20 from the apertures 18 in the bars 12. With a lever 48 at either end of the window and the accompanying apertures 62 therewith, the handle 58 can be employed at either end of the window to release the pins from the aperture and allow the bars to be slid to the side of the window to allow a person to exit through the window in the event of an emergency.

Figure 6:
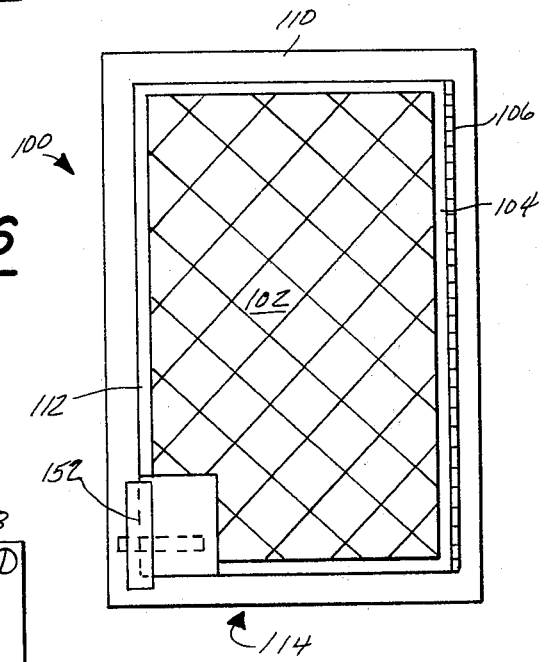
FIG. 6 illustrates an outside front view of a window employing an alternate embodiment of the present invention.

FIG. 6 illustrates at 100 another embodiment of the present invention comprising a burglar proof fire safe window covering 102 mounted to a support frame 104 hinged along one side by a hinge 106 to the frame of the window 110. The covering 102 is preferably of pleasing ornamental design configured to permit light and ventilation to enter the room. The covering 102 comprises a sufficiently high density mesh or close spacing to prevent unaurthorized entry. An opening edge 112 is secured to the frame 110 by a latch mechanism 114.

Figure 7:
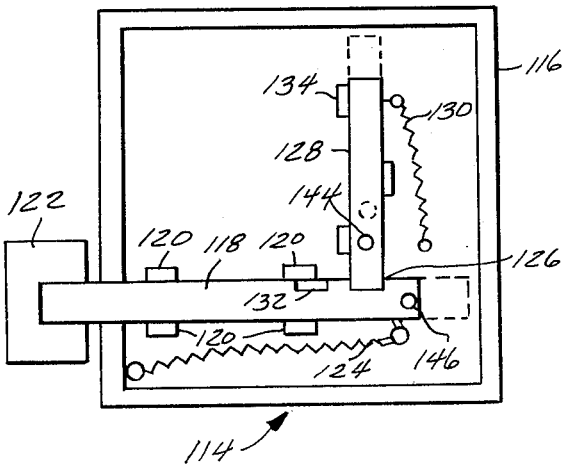
FIG. 7 illustrates a cross-sectional view of the lock mechanism employed in the device of FIG. 6.

The latch mechanism 114 is enclosed by a housing 116, as shown in FIG. 7, and includes therein a horizontal bolt 118 slidingly supported in the housing 116 by a plurality of spaced apart projections 120. The bolt 118 slidingly engages a receiving aperture 122 affixed to the frame 110 to prevent opening of the window covering 102. A first biasing spring 124 affixed at one end to the bolt and at an other end to the housing 116, biases the bolt in a first or locked position locking the opening edge. A first notch 126 engages a vertical lock bar 128 to hold the bolt 118 in the locked position. The vertical lock bolt is biased into the notch 126 by a biasing spring 130 attached at one end to the vertical bolt 128 and at another end to the housing 116. The bolt 118 can be slid from a first or locked position to a second or unlocked position when the vertical bolt 128 is moved vertically out of the slot 126 and the bolt 118 can be urged to its second position where a second notch 132 engages the vertical bolt 128 to hold the bolt 118 in the second or unlocked position. The vertical bolt 128 is slidingly held within the housing 116 by a plurality of projections 134. To move the bolt from the second position to the first position, the vertical lock bar is slid from the slot 132 against the biasing spring 130 and the biasing spring 124 moves the bolt 118 to the first position. Any movement from the first position to the second position and from the second position to the first position must first be accompanied by a movement of the lock bar 128 out of engagement with the first notch 126 or the second notch 132.

Figure 8:
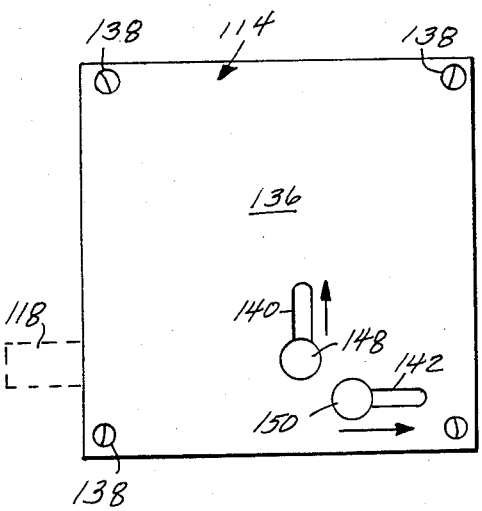
FIG. 8 illustrates an inside view of the lock mechanism of FIG. 7 with the cover plate in place.

A cover plate 136, shown in FIG. 8 closes the housing 116 and is secured thereto by a plurality of threaded fasteners 138 which pass through a plurality of apertures (not shown) in the cover 136 aligned with a plurality of threaded apertures (not shown) in the housing 116. A pair of slots 140 and 142 in the cover are aligned with a pair of pins 144 and 146 affixed to the vertical lock bar 128 and the bolt 118 respectively, as shown in FIG. 7. The pins 144 and 146 allow the vertical lock bar 128 and the bolt 118 to be selectively positioned by hand. A pair of low profile buttons 148, 150 are affixed to an outer end of the pins 144 and 146 and have a depressed center to allow finger engagement of the buttons for movement of the pins 144, 146 along the slots 140 and 142. The low profile buttons 148 and 150 prevent an unauthorized manipulation of the buttons when the window covering 100 is closed.

A hardened steel safety plate 152, FIG. 6, overlaps the space between the window opening edge and the frame abutting an outer surface of the window proximate the bolt. This plate prevents a burglar from cutting the bolt from the outside.

Having thus described my invention what I claim is:

1. A burglar proof fire safe window covering comprising:

a plurality of vertical bars slidingly supported at an upper and a lower end by a pair of spaced apart tracks disposed along an upper and lower inside edge of the window;

a plurality of pin engaging apertures at an upper and a lower end of the bars;

an upper and lower plurality of vertically movable pins releasably biased into engagement with the apertures; and means for releasably engaging the pins in the apertures.

2. The burglar proof window covering as defined in claim 1 wherein the means for releasably engaging the pins in the apertures comprises:

an upper and lower vertically movable horizontal wall to engage a projection on the pin;

an upper and a lower lever operated cam, rotation of said cams moves the horizontal wall against the pin projection to move the pins out of engagement with the apertures;

a link pivotally interconnecting the upper and lower levers;

a handle releasably connected to one of said levers; and wherein rotation of the handle in a first direction moves the pins into engagement with the apertures, and rotation of the handle in a second direction disengages the pins from the apertures.

3. The burglar proof window covering as defined in claim 1 further comprising:

means for positioning the bars in alignment with the pins.

4. The burglar proof window covering as defined in claim 3 wherein the means for positioning the bars in alignment with the pins comprises a length of chain between adjacent bars to fix the spacing between bars.

5. The burglar proof window covering as defined in claim 3 wherein the means for positioning the bars in alignment with the pins comprises an extending scissors linkage to mechanically establish an equal spacing between bars as they are extended and retracted.

6. A burglar proof fire safe window covering comprising:

a support frame attached to an outer portion of a window frame;

a burglar proof grill hinged to the support frame along a vertical edge;

a latch affixed to the grill along an opening edge opposite the hinge; and the latch comprising a housing, a horizontal bolt slidingly supported by the housing, the bolt movable between a first position locking the opening edge to the support frame and a second position releasing the opening edge, a first notch along an upper surface of the bolt, a second notch spaced from the first notch, a vertical lock bar slidingly supported by the housing to selectively engage the first notch or the second notch, a first bias spring to bias the bolt toward the first position, a second bias spring to bias the vertical lock bar toward the notches, and wherein with the vertical lock bar in the first notch the bolt is locked in the first position, and lifting the vertical lock bar from engagement with the first notch allows the bolt to be slid to the second position where the vertical lock bar engages the second notch holding the bolt in the second position; and a hardened steel safety plate overlapping the space between the opening edge and frame along an outer surface of the window proximate the bolt.

7. The burglar proof window covering as defined in Claim 1 wherein the means for releasably engaging the pins in the apertures comprises:

upper and lower vertically movable, horizontally extending walls engageable with a projection on the pin; and means for moving the upper and lower horizontal walls in a first direction against the pin projections to move the pins out of engagement with the apertures and in a second direction to move the pins into engagement with the apertures.

8. The burglar proof window covering as defined in Claim 7 wherein the moving means includes removable handle means for moving the moving means in either of the first and second directions.

9. The burglar proof window covering as defined in Claim 7 wherein the moving means comprises upper and lower lever operated cams, rotation of the cams moving the horizontal walls against the pin projections to move the pins out of engagement with the apertures:

a link pivotally interconnecting the upper and lower levers; and a handle removably connected to one of the levers wherein rotation of the handle in a first direction moves the pins into engagement with the apertures and rotation of the handle in a second direction disengages the pins from the apertures.

* * * * *